US010208684B2

(12) United States Patent
He et al.

(10) Patent No.: US 10,208,684 B2
(45) Date of Patent: Feb. 19, 2019

(54) METHOD AND APPARATUS FOR CONTROLLING OPERATION OF AN INTERNAL COMBUSTION ENGINE

(71) Applicant: GM Global Technology Operations LLC, Detroit, MI (US)

(72) Inventors: Yongsheng He, Sterling Heights, MI (US); Jim Liu, Shanghai (CN); David Sun, Shanghai (CN); Jonathan T. Shibata, Whitmore Lake, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/557,613

(22) PCT Filed: Mar. 13, 2015

(86) PCT No.: PCT/CN2015/074191
§ 371 (c)(1),
(2) Date: Sep. 12, 2017

(87) PCT Pub. No.: WO2016/145565
PCT Pub. Date: Sep. 22, 2016

(65) Prior Publication Data

US 2018/0045126 A1 Feb. 15, 2018

(51) Int. Cl.
*F02D 35/00* (2006.01)
*F02D 35/02* (2006.01)
*F02D 11/10* (2006.01)

(52) U.S. Cl.
CPC ..... *F02D 35/028* (2013.01); *F02D 11/105* (2013.01); *F02D 35/026* (2013.01);
(Continued)

(58) Field of Classification Search
CPC .... F02D 35/028; F02D 35/026; F02D 11/105; F02D 2200/602; F02D 2200/021; F02D 2200/022
See application file for complete search history.

(56) References Cited

U.S. PATENT DOCUMENTS 9,399,959 B2 * 7/2016 Whitney ..... F02D 41/222
2004/0094124 A1 * 5/2004 Viele ..... F02D 35/021 123/406.27

(Continued)

FOREIGN PATENT DOCUMENTS

CN 103502607 A 1/2014
JP 2006009720 A 1/2006

OTHER PUBLICATIONS

International Search Report on Internation Application No. PCT/CN2015/074191, dated Dec. 21, 2015, 11 pages.

*Primary Examiner* — Hieu T Vo
*Assistant Examiner* — Sherman Manley
(74) *Attorney, Agent, or Firm* — Quinn IP Law

(57) ABSTRACT

An internal combustion engine includes a method for operating including, determining, using an accelerator pedal position sensor, an operator request for power and determining an engine operating point based upon the operator request for power. A motored-cylinder temperature is determined based upon the engine operating point, and a knock-limited combustion phasing point is determined based upon the motored-cylinder temperature and the engine operating point. Engine operating parameters associated with achieving the knock-limited combustion phasing point are selected. Operation includes controlling, by a controller, engine control states in response to the engine operating parameters associated with achieving the knock-limited combustion phasing point and the operator request for power.

19 Claims, 3 Drawing Sheets

(52) U.S. Cl.
CPC .. *F02D 2200/021* (2013.01); *F02D 2200/022* (2013.01); *F02D 2200/602* (2013.01)

(56) References Cited

U.S. PATENT DOCUMENTS

| | | | | |
|---|---|---|---|---|
| 2011/0114069 | A1* | 5/2011 | Grannell | F02D 41/0025 123/585 |
| 2012/0290189 | A1* | 11/2012 | Davis | F02D 15/00 701/102 |
| 2014/0053808 | A1* | 2/2014 | Nakasaka | F02D 13/0238 123/406.12 |
| 2015/0159618 | A1* | 6/2015 | Nakasaka | F02P 5/152 123/406.33 |
| 2015/0275784 | A1* | 10/2015 | Whitney | F02D 13/02 701/102 |
| 2016/0305351 | A1* | 10/2016 | Barta | F02D 41/14 |
| 2017/0168466 | A1* | 6/2017 | Sun | G05B 13/026 |
| 2017/0328333 | A1* | 11/2017 | Attard | F02D 35/027 |
| 2017/0356350 | A1* | 12/2017 | Li | F02D 11/02 |
| 2018/0171937 | A1* | 6/2018 | Shelby | F02M 25/0227 |

* cited by examiner

METHOD AND APPARATUS FOR CONTROLLING OPERATION OF AN INTERNAL COMBUSTION ENGINE

TECHNICAL FIELD

The present disclosure relates to internal combustion engines and more particularly to control systems for spark-ignition engines.

BACKGROUND

Internal combustion engines combust an air and fuel mixture within cylinders to drive pistons and produce torque. Air flow into a spark-ignition engine is regulated via an operator-controllable throttle, and fuel flow is controlled to achieve an air/fuel ratio that is responsive to an operator request for power.

SUMMARY

An internal combustion engine is described, and a method for operating the internal combustion engine includes: determining, using an accelerator pedal position sensor, an operator request for power; and determining an engine operating point based upon the operator request for power. A motored-cylinder temperature is determined based upon the engine operating point, and a knock-limited combustion phasing point is determined based upon the motored-cylinder temperature and the engine operating point. Engine operating parameters associated with achieving the knock-limited combustion phasing point are selected. Operation includes controlling, by a controller, engine control states in response to the engine operating parameters associated with achieving the knock-limited combustion phasing point and the operator request for power.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

DETAILED DESCRIPTION

Figure 1:
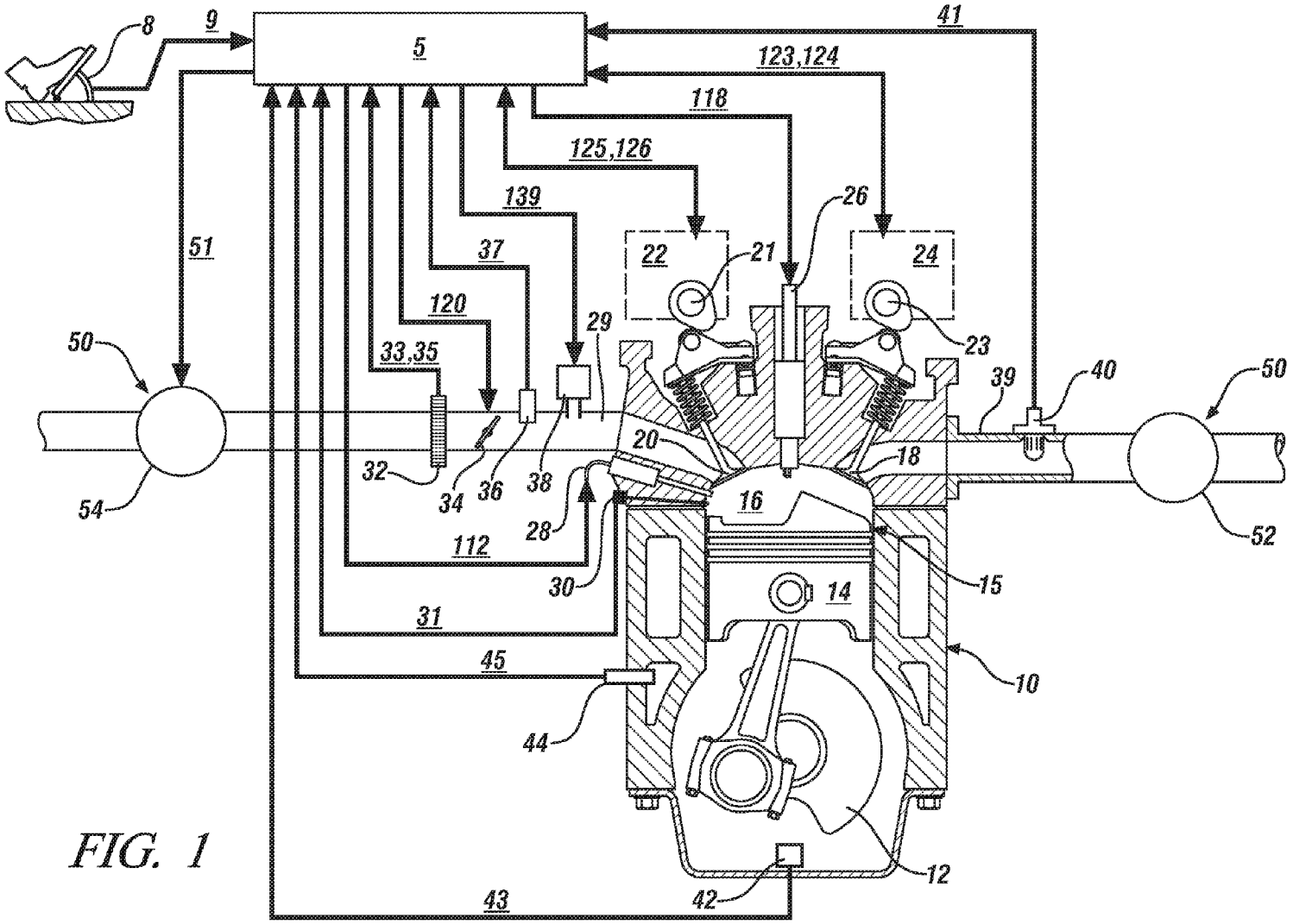
FIG. 1 schematically illustrates a cutaway side-view sketch of an internal combustion engine and an accompanying controller, in accordance with the disclosure.

The following description is merely exemplary in nature and is in no way intended to limit the disclosure, its application, or uses. Like reference numerals indicate like or corresponding elements throughout the several drawings. Terms and acronyms used herein include engine speed in revolutions per minute (RPM), engine piston position and crankshaft rotational position in rotational degrees (deg) in terms of top-dead-center (TDC), a before-TDC rotational position (deg bTDC), an after-TDC rotational position (deg aTDC), and a bottom-dead-center position (BDC). The term 'engine operating parameter' refers to any quantifiable value related to engine operation that may be directly measured, inferred, estimated or otherwise determined by a controller. The term 'engine control state' refers to any controllable state for an actuator component or system that may be commanded by a controller.

Referring now to the drawings, wherein the depictions are for the purpose of illustrating certain exemplary embodiments only and not for the purpose of limiting the same, FIG. 1 schematically illustrates a cutaway side-view sketch of an internal combustion engine (engine) 10 and an accompanying controller 5 that have been constructed in accordance with an embodiment of this disclosure. For illustration purposes, a single representative cylinder 15 is shown. The engine 10 may include multiple cylinders. For example only, the engine 10 may include 2, 3, 4, 5, 6, 8, 10, and/or 12 cylinders. The engine 10 as shown is configured as a spark-ignition internal combustion engine, and may be configured to operate primarily at a stoichiometric air/fuel ratio in one embodiment. The disclosure may be applied to various internal combustion engine systems and combustion cycles.

The exemplary engine 10 may include a multi-cylinder four-stroke internal combustion engine having reciprocating pistons 14 slidably movable in cylinders 15 that define variable volume combustion chambers 16. Each piston 14 connects to a rotating crankshaft 12 by which linear reciprocating motion translates to rotational motion. An air intake system provides intake air to an intake manifold 29 which directs and distributes air into intake runners of the combustion chambers 16. The air intake system has airflow ductwork and devices for monitoring and controlling the air flow. The air intake devices preferably include a mass airflow sensor 32 for monitoring mass airflow (MAF) 33 and intake air temperature (IAT) 35. A throttle valve 34 preferably includes an electronically controlled device that is used to control airflow to the engine 10 in response to an airflow control state (ETC) 120 from the controller 5. A pressure sensor 36 in the intake manifold 29 is configured to monitor manifold absolute pressure (MAP) 37 and barometric pressure. The engine 10 may include an external flow passage that recirculates exhaust gases from engine exhaust to the intake manifold 29, having a flow control valve referred to as an exhaust gas recirculation (EGR) valve 38 in one embodiment. Alternatively, no exhaust gas recirculation (EGR) valve 38 or external flow passages are employed. The controller 5 controls mass flow of exhaust gas to the intake manifold 29 by controlling the EGR valve 38 via an EGR control state 139. An intake air compressor system 50 is configured to control flow of intake air to the engine 10 in response to a compressor boost control state 51, and may include a variable-geometry turbocharger (VGT) system that includes a turbine device 52 located in the exhaust gas stream rotatably coupled to an intake air compressor device 54 that is configured to increase flow of engine intake air. An air intercooler device may be fluidly located between the intake air compressor device 54 and the engine intake manifold 29 in one embodiment. Alternatively, the intake air compressor system 50 may include a shaft-driven or electrically-driven supercharger device, or another suitable air compressing system.

Airflow from the intake manifold 29 into the combustion chamber 16 is controlled by one or more intake valve(s) 20 per cylinder. Exhaust flow out of the combustion chamber 16 to an exhaust manifold 39 is controlled by one or more exhaust valve(s) 18 per cylinder. The engine 10 is equipped with systems to control and adjust openings and closings of either or both of the intake and exhaust valves 20 and 18, including adjusting cam phasings of only the intake valves 20, adjusting cam phasings of only the exhaust valves 18, adjusting cam phasings of both the intake valves 20 and the exhaust valves 18, adjusting magnitude of valve lift of the intake valves 20, adjusting magnitude of valve lift of the exhaust valves 18, adjusting magnitude of valve lift of the intake valves 20 and the exhaust valves 18, and combinations thereof. In one embodiment, the openings and closings of the intake and exhaust valves 20 and 18 may be controlled and adjusted by controlling intake and exhaust variable cam phasing/variable lift control (VCP/VLC) devices 22 and 24, respectively. The intake and exhaust VCP/VLC devices 22 and 24 control openings and closings of the intake and exhaust valves 20 and 18, including controlling rotations intake camshaft 21 and an exhaust camshaft 23, respectively. The rotations of the intake and exhaust camshafts 21 and 23 are linked to and indexed to rotation of the crankshaft 12, thus linking openings and closings of the intake and exhaust valves 20 and 18 to positions of the crankshaft 12 and the pistons 14. Devices and control routines associated with intake and exhaust VCP/VLC devices 22 and 24 may be any suitable device or combination of devices, and include, by way of example, cam phasers, two-step lifters and solenoid-controlled valve actuators, among others.

The intake VCP/VLC device 22 preferably includes a mechanism operative to switch and control valve lift of the intake valve(s) 20 in response to a control state (iVLC) 125 and variably adjust and control phasing of the intake camshaft 21 for each cylinder 15 in response to a control state (iVCP) 126. The exhaust VCP/VLC device 24 preferably includes a controllable mechanism operative to variably switch and control valve lift of the exhaust valve(s) 18 in response to a control state (eVLC) 123 and variably adjust and control phasing of the exhaust camshaft 23 for each cylinder 15 in response to a control state (eVCP) 124. The intake and exhaust VCP/VLC devices 22 and 24 each preferably includes a controllable two-step VLC mechanism operative to control magnitude of valve lift, or opening, of the intake and exhaust valve(s) 20 and 18, respectively, to one of two discrete steps. The two discrete steps preferably include a low-lift valve open position (about 4-6 mm in one embodiment) preferably for low speed, low load operation, and a high-lift valve open position (about 8-13 mm in one embodiment) preferably for high speed and high load operation. The intake and exhaust VCP/VLC devices 22 and 24 each preferably includes a variable cam phasing mechanism to control and adjust phasing (i.e., relative timing) of opening and closing of the intake valve(s) 20 and the exhaust valve(s) 18 respectively. Adjusting phasing refers to shifting opening times of the intake and exhaust valve(s) 20 and 18 relative to positions of the crankshaft 12 and the piston 14 in the respective cylinder 15. The VCP mechanisms of the intake and exhaust VCP/VLC devices 22 and 24 each preferably has a range of phasing authority of about 60° -90° of crank rotation, thus permitting the controller 5 to advance or retard opening and closing of one of intake and exhaust valve(s) 20 and 18 relative to position of the piston 14 for each cylinder 15. The range of phasing authority is defined and limited by the intake and exhaust VCP/VLC devices 22 and 24. The intake and exhaust VCP/VLC devices 22 and 24 include camshaft position sensors to determine rotational positions of the intake and the exhaust camshafts 21 and 23. The VCP/VLC devices 22 and 24 are actuated using one of electro-hydraulic, hydraulic, and electric control force, in response to the respective control states eVLC 123, eVCP 124, iVLC 125, and iVCP 126.

The engine 10 may employ a direct-injection fuel injection system including a plurality of high-pressure fuel injectors 28 that are employed to directly inject a mass of fuel into one of the combustion chambers 16 in response to an injector pulsewidth control state (INJ_PW) 112 from the controller 5. Alternatively, the engine 10 may employ a port-injection fuel injection system (PFI) including a plurality of fuel injectors that inject a mass of fuel into intake runners of the intake manifold 29 upstream of the combustion chambers 16.

The fuel injectors 28 are supplied pressurized fuel from a fuel distribution system. The engine 10 employs a spark-ignition system by which spark energy may be provided to a spark plug 26 for igniting or assisting in igniting cylinder charges in each of the combustion chambers 16 in response to a spark control state (IGN) 118 from the controller 5.

The engine 10 may be equipped with various sensing devices for monitoring engine operation, including a crank sensor 42 having an output indicative of crankshaft rotational position, i.e., crank angle, and engine speed (RPM) 43. A temperature sensor 44 is configured to monitor coolant temperature 45. In one embodiment, an in-cylinder combustion sensor 30 may be employed to dynamically monitor combustion 31 during each combustion cycle, and may be a cylinder pressure sensor operative to monitor in-cylinder combustion pressure in one embodiment. An exhaust gas sensor 40 may be configured to monitor an exhaust gas parameter 41, e.g., air/fuel ratio (AFR). The combustion and the engine speed 43 are monitored by the controller 5 to dynamically determine combustion timing, i.e., timing of combustion pressure relative to the crank angle of the crankshaft 12 for each cylinder 15 for each combustion cycle. It is appreciated that combustion timing may be determined by other methods. The controller 5 may communicate with various sensing devices for monitoring operator requests, including, e.g., an accelerator pedal sensor 8 that generates an operator torque request 9. Other related operator requests, e.g., vehicle braking and cruise control may be comprehended by and included in the operator torque request 9.

The term controller and related terms control module, module, control, control unit, processor and similar terms refer to any one or various combinations of Application Specific Integrated Circuit(s) (ASIC), electronic circuit(s), central processing unit(s), e.g., microprocessor(s) and associated non-transitory memory component in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning and buffer circuitry and other components that may be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms and similar terms mean any controller-executable instruction sets including calibrations and look-up tables. Each controller executes control routine(s) to provide desired functions, including monitoring inputs from sensing devices and other networked controllers and executing control and diagnostic routines to control operation of actuators. Routines may be executed at regular intervals, for example each 100 microseconds or 3.125, 6.25, 12.5, 25 and 100 milliseconds during ongoing operation. Alternatively, routines may be executed in response to occurrence of a triggering event. Communications between controllers and between controllers, actuators and/or sensors may be accomplished using a direct wired link, a networked communications bus link, a wireless link or any another suitable communications link. Communications include exchanging data signals in any suitable form, including, for example, electrical signals via a conductive medium, electromagnetic signals via air, optical signals via optical waveguides, and the like. The term 'model' refers to a processor-based or processor-executable code and associated calibration that simulates a physical existence of a device or a physical process. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like. As used herein, the terms 'dynamic' and 'dynamically' describe steps or processes that are executed in real-time and are characterized by monitoring or otherwise determining states of parameters and regularly or periodically updating the states of the parameters during execution of a routine or between iterations of execution of the routine.

The controller 5 is shown as a unitary element. It is appreciated that the controller 5 may include a plurality of controllers that are communicatively coupled via a bus, direct wiring or another mechanism. Such controllers may include a fuel controller that controls operation of the fuel injector 28 to inject fuel into the combustion chamber 16, a spark actuator controller that controls energizing the spark plug 26 to ignite the A/F mixture, a valve actuation controller that controls openings and/or closings of the intake valves and/or exhaust valves 20, 18, a turbocharger boost controller 58 for controlling waste gate position and turbine geometry, an EGR controller and an ETC controller, by way of example.

Figure 2:
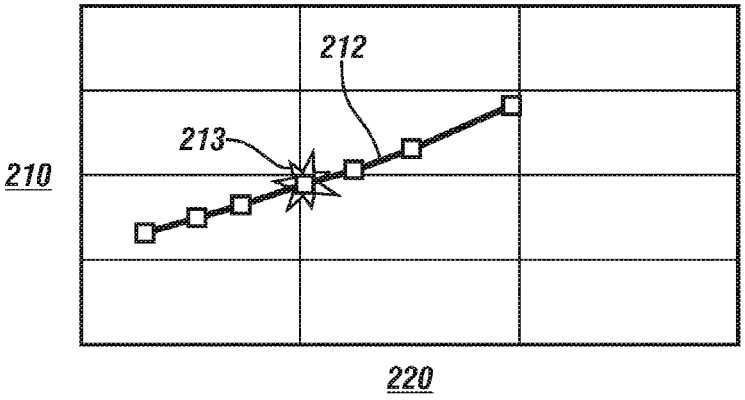
FIG. 2 graphically shows data associated with operating an embodiment of the engine described with reference to FIG. 1, including specific fuel consumption in relation to combustion phasing at one engine speed/load operating point under several engine control states, in accordance with the disclosure.

FIG. 2 graphically shows data associated with operating an embodiment of the engine 10 described with reference to FIG. 1, including specific fuel consumption (BSFC) in relation to combustion phasing at one engine speed/load operating point under several engine control states. The specific fuel consumption is a brake-specific fuel consumption (BSFC, g/kW-h) on the vertical axis 210, which is plotted in relation to combustion phasing (CA50, deg aTDC) on the horizontal axis 220. The engine speed/load operating point is 2000 RPM at 16 bar. The plotted data includes several engine control states that achieve the engine speed/load operating point of 2000 RPM at 16 bar over a range of combustion phasing points. The engine control states include a baseline operation 212 at a 9.3:1 compression ratio. The combustion phasing is described in terms of mass-burn-fraction (MBF) point, which indicates a crank angle and associated piston position at which a portion of the mass fraction of a cylinder charge is burned. The combustion phasing is described as a mass-burn-fraction point of CA50 (deg aTDC), which indicates a crank angle and associated piston position at which an accumulated heat release of a cylinder charge reaches 50% of a total heat release for the cylinder charge. In one embodiment, the CA50 point for a cylinder charge may be determined by monitoring in-cylinder combustion pressure. It is appreciated that other combustion timing parameters may be monitored to achieve similar results. Plotted data also indicates an optimal CA50 point, which may be a CA50 that occurs immediately before the onset of unacceptable engine knock for each engine operating state associated with the engine speed/load operating point of 2000 RPM at 16 bar. Engine knock is an engine operating phenomenon that may occur under specific engine operating conditions due to a situation-specific incorrect spark ignition timing that may lead to audible noise and elevated in-cylinder pressure and may have undesirable effects upon engine operation and service life.

The plotted data shows a decrease in BSFC with an advance in the combustion phasing, with a minimum permissible combustion phasing point determined based upon the onset of unacceptable knock. The plotted data also includes the optimal CA50 point for each of the engine control states. The optimal CA50 point indicates the most advanced combustion timing state that achieves knock-limited combustion timing state 213 associated with the baseline operation 212. Such data may be derived for a representative embodiment of the engine 10 described herein for each of a plurality of engine speed/load operating points and for each of a plurality of engine control states and combustion timing states. The derived engine data may be stored in a memory device, e.g., a non-transitory memory component that is accessible by the engine controller 5.

Figure 3:
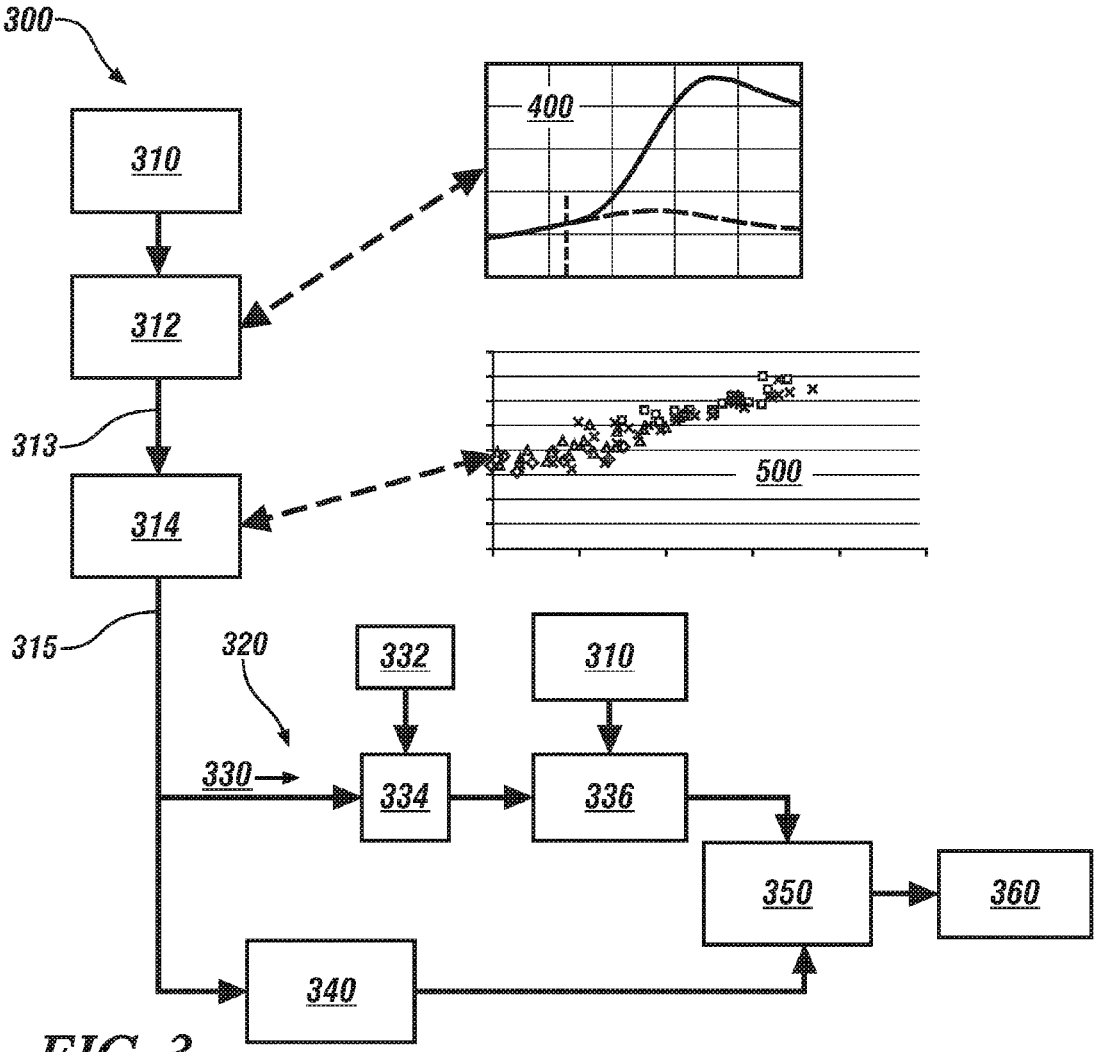
FIG. 3 schematically shows a combustion phasing control routine that includes controlling engine operation based upon a knock-limited combustion phasing point, in accordance with the disclosure.

FIG. 3 schematically shows a combustion phasing control routine 300 that includes controlling engine operation based upon a knock-limited combustion phasing point. An embodiment of the engine 10 and control system described hereinabove may be advantageously controlled by executing the combustion phasing control routine 300. The combustion phasing control routine 300 may be executed as a single routine in one of the controllers, or may be executed as a plurality of routines that are dispersed in the various controllers. Table 1 is provided as a key wherein the numerically labeled blocks and the corresponding functions are set forth as follows, corresponding to the combustion phasing control routine 300.

TABLE 1

| BLOCK | BLOCK CONTENTS |
|---|---|
| 310 | Monitor engine operation, engine operating point and operator request for power |
| 312 | Estimate motored-cylinder temperature (TC20) |
| 314 | Determine preferred knock-limited combustion phasing point (CA50-KL) using motored-cylinder temperature TC20 |
| 320 | Control engine operation |

TABLE 1-continued

| BLOCK | BLOCK CONTENTS |
|---|---|
| 330 | Execute feedback engine control |
| 332 | Determine target CA50 point |
| 334 | Calculate Δ(CA50-KL, target CA50) |
| 336 | Execute feedback control |
| 340 | Execute feed-forward engine control |
| 350 | Control engine control states |
| 360 | Monitor engine operation and execute on-board diagnostic routines |

The combustion phasing control routine 300 periodically executes to select engine control states and engine operating parameters associated with a knock-limited combustion phasing point that achieves engine operation at a minimum BSFC for an engine speed/load operating point. The combustion phasing control routine 300 monitors engine operation including various engine operating parameters and an engine speed/load operating point, and an operator request for power in the form of an operator torque request (310). Monitored or otherwise determined engine operating parameters for the engine 10 described with reference to FIG. 1 may include, by way of example, the operator torque request 9, combustion pressure 31, coolant temperature 45, RPM 43, MAP 37, IAT 35, MAF 33 and AFR 41. Engine control states for the engine 10 described with reference to FIG. 1 may include, by way of example, any one or more of compressor boost 51, INJ_PW 112, IGN 118, ETC 120, eVLC 123, eVCP 124, iVLC 125, iVCP 126 and EGR 139. An estimated combustion parameter may be determined, and preferably includes a combustion phasing point, e.g., CA50 (deg aTDC) or another suitable combustion parameter that may be calculated using the aforementioned engine operating parameters.

A motored-cylinder temperature point may be determined for the engine speed/load operating point (312), which may include interrogating a first calibration 400. The motored-cylinder temperature point is an in-cylinder compression temperature immediately prior to combustion ignition, e.g., before ignition of a combustion charge by a spark plug. The in-cylinder compression temperature may be measured, estimated, or otherwise determined for a motored engine, which is an engine that is spinning in an unfueled condition. The motored-cylinder temperature point is preferably selected at a specific engine crank angle that occurs during a combustion cycle immediately prior to onset of combustion. The first calibration 400 may be employed to estimate or otherwise determine a motored-cylinder temperature point based upon monitored engine operation, with an embodiment of such estimation described with reference to FIG. 4.

Figure 4:
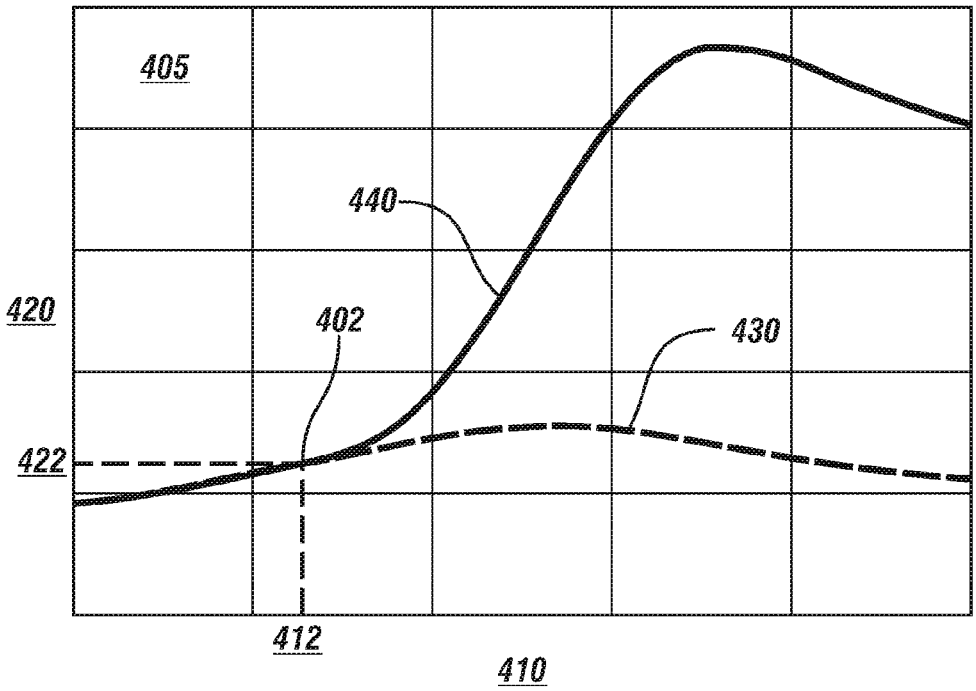
FIG. 4 graphically shows data associated with engine operation over a portion of a single combustion cycle, including in-cylinder temperatures over a portion of a compression stroke followed by a portion of a power stroke, in accordance with the disclosure.

FIG. 4 graphically shows exemplary data 405 associated with engine operation over a portion of a single combustion cycle at one known speed/load engine operating point with the engine operating warmed up under steady-state conditions, and may be representative of a portion of the first calibration 400. The exemplary data includes in-cylinder temperatures 420 over a portion of a compression stroke followed by a portion of a power stroke as indicated by engine crank angle 410 between 60 deg bTDC and 90 deg aTDC. A first of the in-cylinder temperatures is an in-cylinder compression temperature 430 over the portion of the single combustion cycle that indicates in-cylinder temperature during engine motoring, i.e., with the engine spinning in an unfueled state. A second of the in-cylinder temperatures is an in-cylinder combustion temperature 440 that indicates in-cylinder temperature over the portion of the single combustion cycle during engine operation, i.e., with the engine operating in a fueled state. The in-cylinder compression temperature 430 tracks the in-cylinder combustion temperature 440 during engine rotation prior to TDC and prior to ignition of the combustion charge associated with the in-cylinder combustion temperature 440. A specific motored-cylinder temperature point (TC20) 402 is indicated at 20 deg bTDC 412, i.e., just prior to ignition of the combustion charge. The TC20 point 402 for the in-cylinder compression temperature 430 indicates a corresponding motored-cylinder temperature point 422, which is a temperature of a cylinder charge immediately prior to combustion ignition for the engine operating point. The exemplary data 405 shown with reference to FIG. 4 is associated with a single engine speed/load operating point that forms a portion of the first calibration 400. The first calibration 400 preferably includes an in-cylinder compression temperature and a corresponding specific motored-cylinder temperature point (TC20) 313 for each of a plurality of engine speed/load operating points over a range of engine speeds from idle to redline and over a range of engine loads from a closed throttle to a wide-open throttle.

Referring again to FIG. 3, the motored-cylinder temperature point (TC20) 313 is employed in a knock-limited combustion phasing model to estimate or otherwise predict a preferred knock-limited combustion phasing (CA50-KL) point 315 for the engine speed/load operating point (314). The preferred CA50-KL point for the engine speed/load operating point may be determined by interrogating a second calibration 500. The second calibration 500 may be employed to estimate or otherwise determine a preferred CA50-KL point for the engine speed/load operating point based upon the motored-cylinder temperature point (TC20), with embodiments of such estimation described with reference to FIG. 5.

Figure 5:
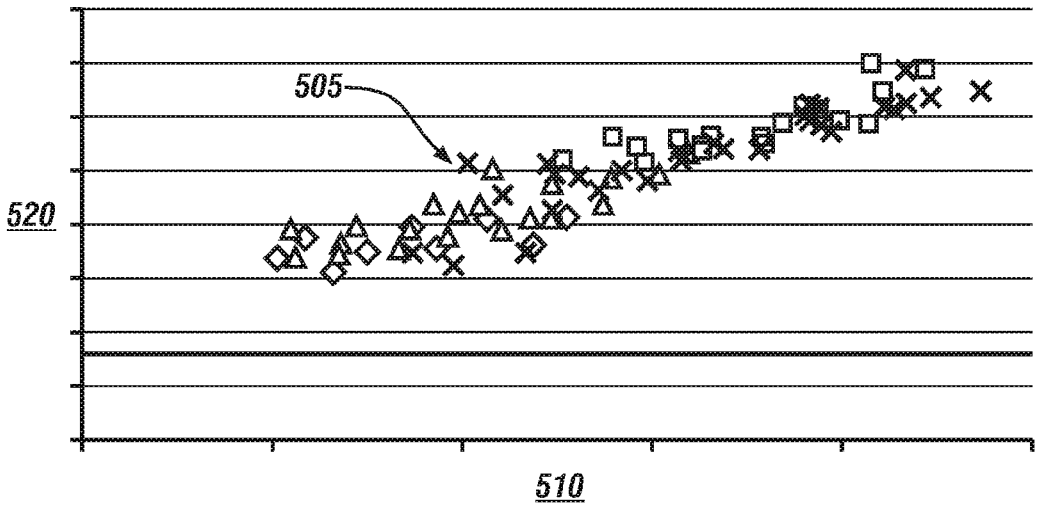
FIG. 5 graphically shows data associated with engine operation at engine speed/load operating points for a plurality of engine control states showing a combustion phasing point indicated by a knock-limited 50% mass-burn-fraction point that correlates to a motored-cylinder temperature point, in accordance with the disclosure.

FIG. 5 graphically shows data 505 associated with engine operation at one engine speed/load operating point of 1000 RPM and 210 Nm with the engine operating warmed up under steady-state conditions for a plurality of engine control states, and may be representative of a portion of the second calibration 500. The data shows a combustion phasing point indicated by a knock-limited 50% mass-burn-fraction point (CA50-KL, deg aTDC) on the vertical axis 520 that correlates to a motored-cylinder temperature point (TC20 point) on the horizontal axis 510. The engine control states and associated engine operating parameters include different engine control routines to operate the engine at the same speed/load point, and shows that the combustion phasing point indicated by a knock-limited 50% mass-burn-fraction point (CA50-KL, deg aTDC) is only dependent on the motored-cylinder temperature point indicated at 20 deg bTDC (TC20 point). The results indicate that the TC20 point may be employed to select a preferred CA50-KL point for the engine operating point of 1000 RPM and 210 Nm, with the preferred CA50-KL point being independent of the engine control states associated with or selected to achieve the engine operating point. The exemplary data 505 shown with reference to FIG. 5 is associated with a single engine speed/load operating point, and thus forms portions of the second calibration 500. The second calibration 500 preferably includes a specific motored-cylinder temperature point (TC20) and a corresponding knock-limited 50% mass-burn-fraction point, i.e., CA50-KL, for each of a plurality of engine speed/load operating points over a range of engine speeds from idle to redline and over a range of engine loads from a closed throttle to a wide-open throttle.

Referring again to FIG. 3, the CA50-KL point identified by interrogating the second calibration 500 in step 314 is employed to control operation of the engine (320), which includes a feedback control routine (330) and a feed-forward control routine (340).

The feedback control routine (330) includes determining a target combustion phasing point, e.g., a CA50 point (332) and calculating a difference between the CA50-KL point and the target CA50 point (334). The target combustion phasing point may be determined using a representative engine operating on an engine dynamometer under known operating temperatures and pressures. The feedback control routine (330) includes employing data obtained from on-vehicle sensors as part of monitoring engine operation (310) including an engine knock sensor, an air/fuel ratio sensor and other combustion related sensors, and adjusting engine control states including, e.g., fuel injection mass, spark timing, intake and exhaust cam phasings, turbocharger boost, and other related parameters in response (336).

The feed-forward control routine (340) preferably includes adjusting various engine control states including, e.g., fuel injection mass, spark timing, intake and exhaust cam phasings, turbocharger boost, and other related parameters responsive to the CA50-KL point.

Engine parameters associated with a cylinder charge that are affected by engine control parameters include as follows: engine mass airflow (MAF) and actual air/fuel ratio, which are controlled by the fuel injection pulsewidth and affects the amount of fuel injected for a cylinder event; intake oxygen, which is controlled by the EGR valve and affects the magnitude of external EGR for a cylinder event; MAP, which is controlled by the ETC and turbocharger (when employed) and affects the magnitude of trapped air mass in the cylinder; and mass-burn-fraction point (CA50 point), which is controlled by spark timing. The engine parameters of MAF, actual air/fuel ratio, intake oxygen, MAP and CA50 point may be directly measured using sensors, inferred from other sensed parameters, estimated, derived from algorithmic models or otherwise determined. The actuators controlling the fuel injection pulsewidth, valve timing and phasing and CA50 point are considered fast actuators because they may implement actuator control states and achieve a preferred operating state to effect a change in engine operation within a single engine cycle. The EGR valve, ETC and turbocharger are considered slow actuators because, although they may implement actuator control states within a single engine cycle, they are unable to achieve a preferred operating state and/or fully effect a change in engine operation until the execution of multiple engine cycles. The effect of a slow actuator upon engine operation is delayed due to system latencies that include communication delays, air, fuel and EGR transport lags, manifold fill times and other factors. Turbocharged engines pressurize air that is drawn into an intake manifold. Thus, a pressure difference may exist between the air in the intake manifold (i.e. pre-combustion) and exhaust gas in an exhaust manifold (i.e. post-combustion). For example, the intake manifold pressure may be higher than the exhaust manifold pressure. Engines that include variable cam phasing and/or variable valve control may selectively open intake and exhaust valves. For example only, an engine may selectively open intake and exhaust valves via cam phasers or energized solenoids. Opening intake and exhaust valves simultaneously in a turbocharged engine may allow higher pressure air in the intake manifold to flow through the cylinder towards the lower pressure exhaust gas in the exhaust manifold. Engine control states are controlled employing results from the feed-forward control routine (340) and the feedback control routine (330), which may include adjusting various engine control states including, e.g., fuel injection mass, spark timing, intake and exhaust cam phasings, turbocharger boost, and other related parameters responsive to the CA50-KL point.

Engine operation is monitored for diagnostic purposes, including evaluating deterioration in engine performance based upon the knock-limited combustion phasing point, the motored-cylinder temperature and the engine operating point (360). This includes monitoring sensors and executing diagnostic models to monitor in-cylinder combustion to evaluate various engine and combustion chamber components and systems, including evaluating performance and performance deterioration over time. Exemplary engine operations that may be monitored include spark plugs, including fouling or tip deterioration, fuel injectors, including occurrence of carbon deposits, and hot spots in a combustion chamber. The engine knock limit is highly influenced by fuel quality, and may also indicate a fault in the engine. Thus, the concepts described herein may be employed to improve the estimation of the knock limit, while the relying on a knock sensor for feedback control.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. A method for operating an internal combustion engine, the method comprising:

determining, using an accelerator pedal position sensor, an operator request for power;

determining an engine operating point based upon the operator request for power;

determining a motored-cylinder temperature based upon the engine operating point;

determining a knock-limited combustion phasing point based upon the motored-cylinder temperature and the engine operating point;

selecting engine operating parameters associated with achieving the knock-limited combustion phasing point; and controlling, by a controller, engine control states in response to the engine operating parameters associated with achieving the knock-limited combustion phasing point and the operator request for power.

2. The method of claim 1, wherein determining a motored-cylinder temperature based upon the engine operating point comprises determining an in-cylinder compression temperature at a predetermined engine crank angle immediately prior to combustion ignition.

3. The method of claim 1, wherein determining a knock-limited combustion phasing point based upon the motored-cylinder temperature and the engine operating point comprises determining a knock-limited 50% mass-burn-fraction point that correlates to the motored-cylinder temperature at the engine operating point.

4. The method of claim 1, wherein determining a knock-limited combustion phasing point based upon the motored-cylinder temperature and the engine operating point comprises selecting a combustion phasing point that achieves a preferred engine operating point responsive to the operator request for power and does not exceed an engine knock limit.

5. The method of claim 4, wherein selecting a combustion phasing point that achieves a preferred engine operating point responsive to the operator request for power and does not exceed an engine knock limit comprises selecting a combustion phasing point that achieves a minimum specific fuel consumption point responsive to the operator request for power that does not exceed the engine knock limit.

6. The method of claim 1, wherein controlling, by a controller, engine control states in response to the engine operating parameters associated with achieving the knock-limited combustion phasing point and the operator request for power comprises executing a feedback control scheme to control the engine control states in response to the engine operating parameters associated with achieving the knock-limited combustion phasing point and a desired combustion phasing point.

7. The method of claim 6, wherein executing the feedback control scheme to control the engine control states in response to the engine operating parameters associated with achieving the knock-limited combustion phasing point and the desired combustion phasing point further comprises controlling the engine control states based upon signal feedback from an air/fuel ratio sensor and a knock sensor.

8. The method of claim 1, wherein controlling, by a controller, engine control states in response to the engine operating parameters associated with achieving the knock-limited combustion phasing point and the operator request for power comprises executing a feed-forward control scheme to control the engine control states in response to the engine operating parameters associated with achieving the knock-limited combustion phasing point.

9. The method of claim 1, further comprising evaluating deterioration in engine performance based upon the knock-limited combustion phasing point, the motored-cylinder temperature and the engine operating point.

10. A method for operating an internal combustion engine, the method comprising:

determining a motored-cylinder temperature based upon an engine operating point in response to an operator request for power;

determining a knock-limited combustion phasing point based upon the motored-cylinder temperature;

selecting engine operating parameters associated with achieving the knock-limited combustion phasing point;

controlling, by a controller, engine control states to achieve the engine operating parameters associated with achieving the knock-limited combustion phasing point for the engine operating point that is in response to the operator request for power; and evaluating, by a controller, deterioration in engine performance based upon the knock-limited combustion phasing point, the motored-cylinder temperature and the engine operating point.

11. The method of claim 10, wherein determining a motored-cylinder temperature based upon the engine operating point comprises determining an in-cylinder compression temperature at a predetermined engine crank angle immediately prior to combustion ignition.

12. The method of claim 10, wherein determining a knock-limited combustion phasing point based upon the motored-cylinder temperature and the engine operating point comprises determining a knock-limited 50% mass-burn-fraction point that correlates to the motored-cylinder temperature at the engine operating point.

13. The method of claim 10, wherein determining a knock-limited combustion phasing point based upon the motored-cylinder temperature and the engine operating point comprises selecting a combustion phasing point that achieves a preferred engine operating point responsive to the operator request for power and does not exceed an engine knock limit.

14. The method of claim 13, wherein selecting a combustion phasing point that achieves a preferred engine operating point responsive to the operator request for power and does not exceed an engine knock limit comprises selecting a combustion phasing point that achieves a minimum specific fuel consumption point responsive to the operator request for power that does not exceed the engine knock limit.

15. The method of claim 10, wherein controlling, by a controller, engine control states in response to the engine operating parameters associated with achieving the knock-limited combustion phasing point and the operator request for power comprises executing a feedback control scheme to control the engine control states in response to the engine operating parameters associated with achieving the knock-limited combustion phasing point and a desired combustion phasing point.

16. The method of claim 15, wherein executing the feedback control scheme to control the engine control states in response to the engine operating parameters associated with achieving the knock-limited combustion phasing point and the desired combustion phasing point further comprises controlling the engine control states based upon signal feedback from an air/fuel ratio sensor and a knock sensor.

17. The method of claim 10, wherein controlling, by a controller, engine control states in response to the engine operating parameters associated with achieving the knock-limited combustion phasing point and the operator request for power comprises executing a feed-forward control scheme to control the engine control states in response to the engine operating parameters associated with achieving the knock-limited combustion phasing point.

18. An internal combustion engine, comprising:

a multi-cylinder four-stroke internal combustion engine having reciprocating pistons slidably movable in cylinders that define variable volume combustion chambers, a plurality of actuators and a plurality of sensors;

a controller including executable routines, the routines including:

determining a motored-cylinder temperature based upon an engine operating point in response to an operator request for power, determining a knock-limited combustion phasing point based upon the motored-cylinder temperature, selecting engine operating parameters associated with achieving the knock-limited combustion phasing point, and controlling engine control states to achieve the engine operating parameters associated with achieving the knock-limited combustion phasing point for the engine operating point that is responsive to the operator request for power.

19. The internal combustion engine of claim 18, wherein the executable routines of the controller further comprises evaluating deterioration in engine performance based upon the knock-limited combustion phasing point, the motored-cylinder temperature and the engine operating point.

* * * * *